United States Patent [19]

Bernhard

[11] 4,019,816

[45] Apr. 26, 1977

[54] COATING SYSTEM HAVING A COMPOSITE APPLICATOR ASSEMBLY PROVIDED WITH A RECIPROCATING BLADE

[75] Inventor: John S. Bernhard, Webster, N.Y.

[73] Assignee: Xerox Corporation, Stamford, Conn.

[22] Filed: May 16, 1975

[21] Appl. No.: 578,296

[52] U.S. Cl. ..... 355/3 P; 118/407; 118/DIG. 23; 355/10; 427/17

[51] Int. Cl.[2] ..... G03G 15/00

[58] Field of Search ..... 355/3 P, 10, 4; 427/15, 427/17; 101/366; 96/1 PE, 1.3; 118/407, 413, 258, 259, DIG. 23

[56] References Cited

UNITED STATES PATENTS

| | | | |
|---|---|---|---|
| 3,192,895 | 7/1965 | Galer | 118/413 X |
| 3,667,428 | 6/1972 | Smith | 118/DIG. 23 |
| 3,696,020 | 10/1972 | Carreira | 355/3 P |
| 3,703,459 | 11/1972 | Little et al. | 118/259 X |
| 3,800,743 | 4/1974 | Egnaczak | 118/259 |

*Primary Examiner*—R. L. Moses

*Attorney, Agent, or Firm*—James J. Ralabate; Richard A. Tomlin; John H. Faro

[57] ABSTRACT

Coating applicator system comprising a stationary blade and a reciprocating applicator blade. A quantity of photoelectrophoretic ink is supplied to the surface of the stationary blade when the applicator plate is cammed out. When the applicator plate is cammed in, the applicator plate moves the ink on the stationary coater blade into the coating gap to supply a uniform quantity of ink to the surface to be coated.

11 Claims, 5 Drawing Figures

FIG. 2
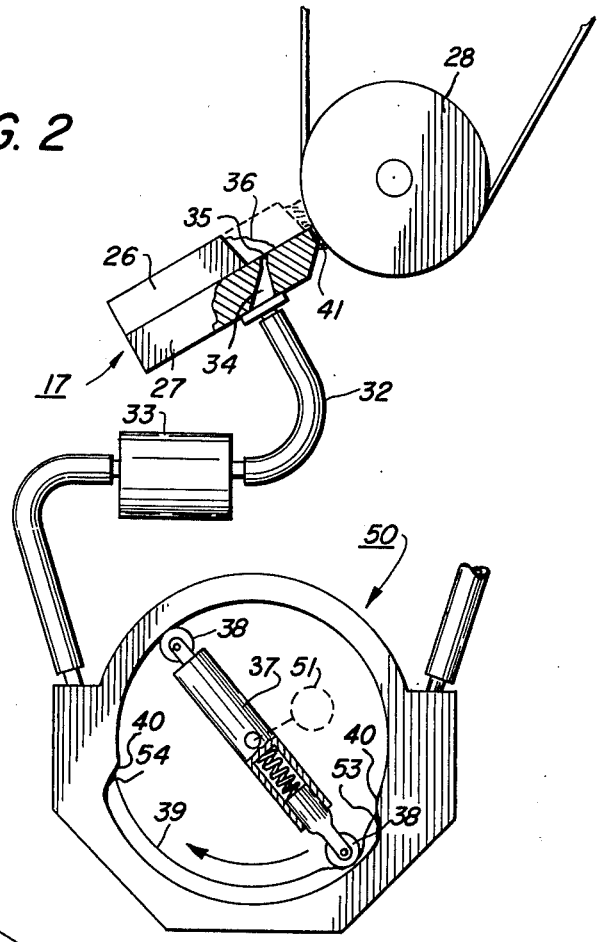
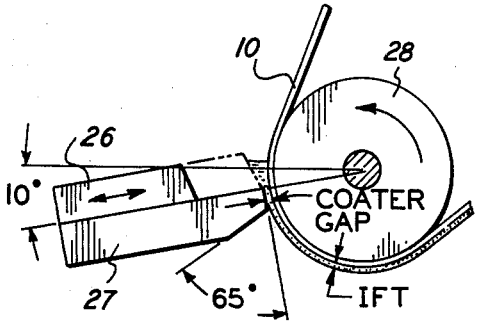
FIG. 2a
FIG. 3
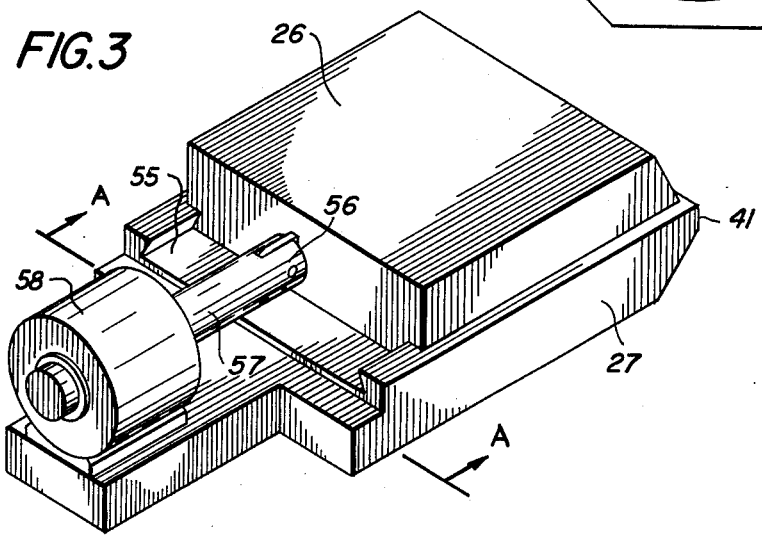
FIG. 4
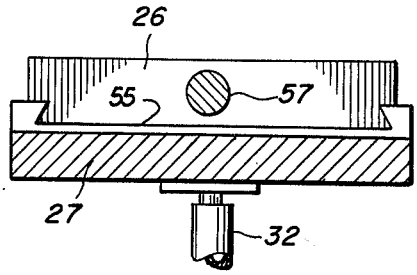

COATING SYSTEM HAVING A COMPOSITE APPLICATOR ASSEMBLY PROVIDED WITH A RECIPROCATING BLADE

BACKGROUND OF THE INVENTION

This invention relates, in general, to coating applicator systems and, more particularly, their use in an improved photoelectrophoretic imaging system.

In the photoelectrophoretic imaging process, monochromatic including black and white or full images, are formed through the use of photoelectrophoresis. An extensive and detailed description of the photoelectrophoretic process is found in U.S. Pat. Nos. 3,384,488 and 3,383,565 to Tulagin and Carreira; 3,383,993 to Yeh and 3,384,566 to Clark, which disclose a system where photoelectrophoretic particles migrate in image configuration providing a visible image at one or both of two electrodes between which the particles suspended within an insulating carrier is placed. The particles are electrically photosensitive and are believed to bear an electrical charge while suspended, which causes them to be attracted to one electrode and apparently undergo a net change in polarity upon exposure to activating electromagnetic radiation. The particles will migrate from one of the electrodes under the influence of an electric field through the liquid carrier to the other electrode.

The photoelectrophoretic imaging process is either monochromatic or polychromatic, depending upon whether the photosensitive particles within the liquid carrier are responsive to the same or different portions of the light spectrum. A full-color polychromatic system is obtained, for example, by using cyan, magenta and yellow colored particles which are responsive to red, green and blue light, respectively.

In photoelectrophoretic imaging generally, and as employed in the instant invention, the important broad teachings in the following four paragraphs should be noted.

Preferably, as taught in the four patents referred to above, the electric field across the imaging suspension is applied between electrodes having certain preferred properties, i.e., an injecting electrode and blocking electrode, and the exposure to activating radiation occurs simultaneously with field application. However, taught in various of the four patents referred to above and Luebbe et al, U.S. Pat. No. 3,595,770; Keller et al, U.S. Pat. No. 3,647,659 Carreira et al, U.S. Pat. No. 3,477,934, such a wide variety of materials and modes for associating an electrical bias therewith, e.g., charged insulating webs, may serve as the electrodes, i.e., the means for applying the electric field across the imaging suspension, that opposed electrodes generally can be used; and that exposure in electrical field applying steps may be sequential. In preferred embodiments herein, one electrode may be referred to as the injecting electrode and the opposite electrode as the blocking electrode. This is a preferred embodiment description. The terms blocking electrode and injecting electrode should be understood and interpreted in the context of the above comments throughout the specification and claims hereof.

It should also be noted that any suitable electrically photosensitive particles may be used. Kaprelian, U.S. Pat. No. 2,940,847 and Yeh, U.S. Pat. No. 3,681,064, disclose various electrically photosensitive particles, as do the four patents referred to above.

In a preferred mode, at least one of the electrodes is transparent, which also encompasses partial transparency that is sufficient to pass enough electromagnetic radiation to cause photoelectrophoretic imaging. However, as described in Weigl, U.S. Pat. No. 3,616,390, both electrodes may be opaque.

Preferably, the injecting electrode is grounded and the blocking electrode is biased to provide the field for imaging. However, such a wide variety of variations in how the field may be applied can be used, including grounding the blocking electrode and biasing the injecting electrode, biasing both electrodes with different bias values of the same polarity, biasing one electrode at one polarity and biasing the other at the opposite polarity of the same or different values, that just applying sufficient field for imaging can be used.

The photoelectrophoretic imaging system disclosed in the above-identified patents may utilize a wide variety of electrode configuration including a transparent flat electrode configuration for one of the electrodes, a flat plate or roller for the other electrode used in establishing the electric field across the imaging suspension.

SUMMARY OF THE INVENTION

Generally, in the above photoelectrophoretic imaging system, a uniform layer of imaging suspension or photoelectrophoretic ink has been applied to the surface of the transparent electrode by a donor drum or by an extruder type applicator.

There has been recently developed a photoelectrophoretic imaging system which utilizes web materials, which optimally may be disposable. In this process, the desired, e.g., photographic positive image, is formed on one of the webs and another web will carry away the negative or unwanted image. The positive image can be fixed to the web upon which it is formed or the image transferring to a suitable backing such as paper. The web which carries the negative image can be rewound and later disposed of. In such photoelectrophoretic imaging systems employing disposable webs, photoelectrophoretic imaging systems employing disposable webs, cleaning systems are not required.

In photoelectrophoretic imaging systems employing the web device configuration, the inking system is required to deliver, apply and distribute a thin film of photoelectrophoretic in comprising mineral oil base ink as a carrier for magenta, cyan and yellow pigments, onto the surface of a web material formed of Mylar with an aluminized substrate. The ink should be of a uniform thickness and must be applied to the web without tailing defects.

Accordingly, it is an object of this invention to provide a coater applicator system to deliver photoelectrophoretic ink to produce an ink film of uniform thickness in a prescribed rectangular area on a moving surface that may be a web.

It is another object of this invention to provide a coating applicator system adapted to supply photoelectrophoretic ink that is easily cleaned.

Another object of the present invention is to provide a coating applicator system suitable for intermittent operation.

Still another object of this invention is to provide a coating applicator system which maybe either manually or automatically supplied with ink.

These and other objects of this invention are accomplished by the use of a coating applicator system comprising a stationary blade and reciprocating applicator plate. A metered amount of ink is distributed onto the stationary coater blade when the applicator plate is cammed out. When the applicator plate is cammed back in, the applicator plate moves the ink into the coating gap onto the moving surface that may be a web. A roller is used to back up the moving web at the inking station. The ink is supplied to the blade coater by a completely automated system which involves a pump, valves and an enclosed sump or by a semi-automated system where ink is deposited on the top part of the blade coater and a metal block is used in an automated motion to deliver the ink to the surface. These inking systems may be used interchangeably.

DESCRIPTION OF THE DRAWINGS

These and other objects and advantages of this improved coating applicator system will become more apparent to those skilled in the art after reading the following detailed description taken in conjunction with the accompanying drawings wherein:

FIG. 2 is a partially schematic diagram of the coater applicator system of the present invention;

FIG. 2*a* is a partially schematic diagram of the features to prevent the trapping of fibers on the top edge of the applicator plate;

FIG. 3 is a perspective isolated view of the coating applicator of FIG. 1;

FIG. 4 is a cross-section taken along line A—A of FIG. 3.

DESCRIPTION OF THE PREFERRED EMBODIMENT

Figure 1:
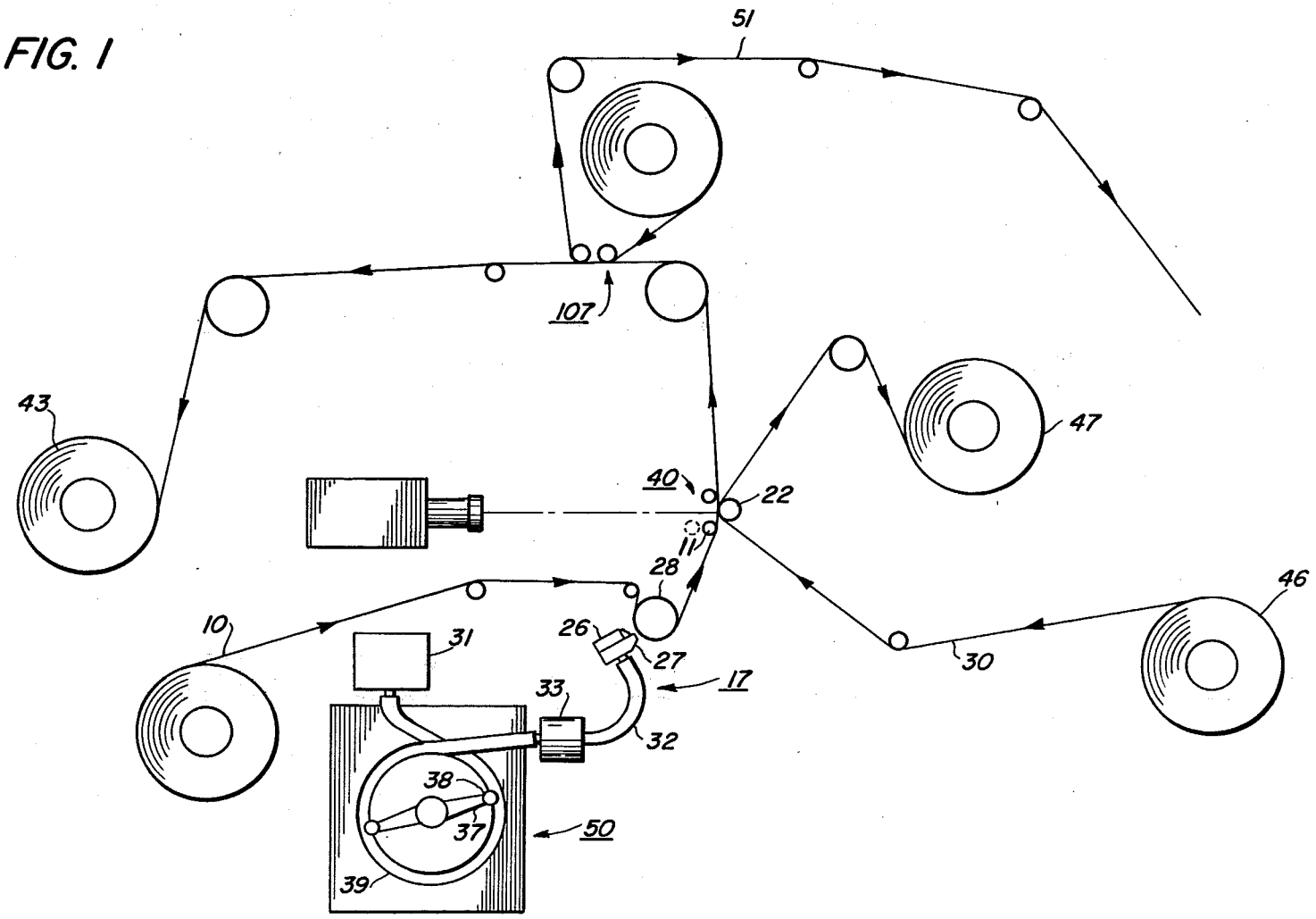
FIG. 1 is a partially schematic presentation of the side view of a photoelectrophoretic imaging system employing a web device configuration comprising a preferred embodiment of the coating applicator system of the present invention.

The invention herein is described and illustrated in specific embodiments having specific components listed for carrying out the functions of the apparatus. Nevertheless, the invention need not be thought of as being confined to such specific showings and should be construed broadly within the scope of the claims. Any and all equivalent structures known to those skilled in the art can be substituted for specific apparatus disclosed as long as the substituted apparatus achieves a similar function. It may be that other methods and apparatus may be invented having similar needs to those fulfilled by the method and apparatus as described and claimed herein, and it is the intention herein to describe and invention for use in apparatus other than the embodiments shown.

Referring now to FIG. 1, there is seen a schematic diagram of a portion of a web device photoelectrophoretic imaging system comprising three webs. The web 30, referred to as the blocking web, is formed of an about 1 mil clear polypropylene blocking material. Web 10, referred to as the injecting web or conductive web, formed of an about 1 mil Mylar, a polyethylene terephethalate polyester film from DuPont, overcoated with a thin transparent conductive material, e.g., about 50% white light transmissive layer of aluminum. The conductive surface of the injecting web 10 is preferably connected to ground roll 11. As will be made clear from the explanation that will be given below by analogy, the functions of the injecting web 10 and blocking web 30 correspond to the functions of the injecting and blocking electrodes, respectively, described in greater detail in the four patents referenced earlier. The web device coating applicator, generally represented as 17, includes the applicator plate 26, coater blade 27 and a rigidly supported backup inking roller 28 mounted for rotation. The coating applicator 17 supplies a metered flow of ink that will provide a uniform ink coating of the desired thickness on the conductive side of the injecting web 11. In one exemplary instance, an approximately 14 inch film ink layer is coated onto the injecting web 10 about 1.25 mils ink film thickness with a tolerance of plus or minus .1 mil.

At the start of the photoelectrophoretic imaging process, the injecting web 10 is driven in the direction of the arrow by a mechanical drive, not shown, which accelerates the injecting web to a constant speed between 3 to 20 inches per second, preferably about 5 inches per second. Before the ink application cycle begins, a signal is delivered to a single revolution, peristaltic type pump, generally represented as 50, from the machine cam bank (not shown). Upon receiving the initial signal, the pump rotor arm 37 rotates in the direction of the arrow, delivering a controlled quantity of ink from the enclosed sump or reservoir 31 to the blade coater 27 through connector tube 32. The ink is then applied to the moving web when the applicator plate is cammed back in the manner described in more particularly hereinafter. The check valve 33, located between the pump 50 and applicator 17 is used to prevent the flow of ink when the pump is in its starting position.

Before the layer of ink film coated on the conductive web 10 reaches the imaging zone, generally designated as 40, the blocking web 30, driven from supply roll 46 in the direction of the arrow by independent drive, not shown, accelerates to a constant speed to match the speed of the injecting web 10. The two webs are brought together at the imaging zone 40 to form the ink web sandwich. The imaging roller 22, which may be formed, for example, of steel or conductive rubber, may be utilized to apply a uniform electrical imaging field across the ink web sandwich. During the period when the ink web sandwich is formed, and simultaneously with the application of the imaging field, exposure of rays of electromagnetic radiation is made through injecting web 10 to the ink web sandwich in the imaging zone. Upon completion of the imaging cycle, the webs separate and pass beyond the imaging areas between frames. The injecting web carries the formed positive image whereas the blocking web 30 carries the negative image. The blocking web 30 is rewound on takeup reel 47 and may be disposed of. The positive image formed on the surface of the injecting web 10 is carried to the transfer zone, generally represented as 107, into contact with a copy web 51 whereat the formed image is transferred to the copy web. After the transfer step, the injecting web and copy webs are separated and the injecting web rewound on takeup reel 43, and the transferred image on the copy web may be fixed and then clipped at the appropriate length by cutting means.

Referring now to FIG. 2, there is seen a side view of the coating applicator system according to this invention. The coating applicator system 20 comprises the applicator 17 and the pump 50, referred to hereinearlier. As will be recalled, when the initiation signal is received from the cam bank, the pump drive means 51, coupled to the arm 37, rotates the arm at constant velocity. Upon receiving the initiation signal, the compression rollers 38, rotatably mounted on the rotor arm 37, makes one half revolution about the inside diameter of the flexible tubing 39 and stops. One complete revolution of the rotor arm 37 will give (2) inking cycles. The rotor arm may also be designed with only one roller 38, in which case, 1 full revolution of the rotor arm 37 will result in one inking cycle. The down ramp 53 represents the beginning or start of delivery and the up ramp 54 the end of delivery or point of disengagement between the compression rollers with the flexible tube.

The ink delivered by the pump 50 is forced upward through the blade coater cavity 34, forming a meniscus 36 at the exit of the coater orifice 35. The second signal from the machine cam bank initiates the start of the ink application cycle whereby the reciprocating applicator plate 26 is actuated forward, causing a bead of ink to form in the metering gap between the blade coater and inking roller onto the conductive Mylar web 10 at the required coating thickness. The peristaltic type pump 50 functions such that when the first signal from the cam bank is received, the arm 37 to which the tubing compression roller(s) is (are) mounted makes one half or a complete revolution about the inside diameter of the flexible plastic tubing 39 and stops. Variations in the volumetric ink out put are obtained by either changing the size of the plastic tubing 39 or by varying the compression roller(s) 38 bube contact length. The roller-tubing contact length may be varied by changing the relative position of the set of radial cams 40, which bring the roller in and out of contact with the tubing 39.

It is believed that one of the major causes of coating defects and resultant defects in the image is due to fibers and other materials in the ink. These fibers may become lodged on the top surface of the metering plate and protrude into the coater gap, thereby causing streaks in the applied ink film. Because of the surface tension, the ink tends to hold the agglomerate in place on the blade coater lip. Thus, once streaks are formed they are usually reproduced from film to film unless the coater lip is manually cleaned.

Referring now to FIG. 2*a*, there is shown two features of the present invention to help prevent the trapping of fibers on the top edge of the application plate. First, the angle of inclination of the blade coater assembly, e.g., the angle of the applicator plate 26 with respect to the inking roller 28 is reduced to about 10°. The 10° angle will reduce the gravitational forces holding the agglomerates on the upper part of the coater lip. Second, the edge of the blade coater 27 is beveled to a relief angle of about 65° to 70° in order to allow the ink agglomerates to gradually channel into the metering gap. Thus, the viscous flow forces of the ink will assist in pulling agglomerates and fibers through the coater gap. The blade coater metering lip 41, preferably, may be between 20 to 30 mils in width.

Still referring to FIG. 2*a*, then the applicator plate 26 is cammed forward to apply metered amounts of ink into the coater gap, the final ink-film thickness (IFT) on the web 10 is in direct proportion to the width of the coater gap. i.e., the width of the coater gap determines the final applied film thickness.

It will be appreciated that although the single (or half) revolution peristaltic type pump is preferred, various other types of pumps may also be used to automatically deliver controlled quantities of ink to the blade coater. For example, a piston type pump with solenoid valves or progressing cavity type pumps may be used.

In FIG. 3, there is shown an isolated perspective view of the applicator 17. The applicator or push plate 26 is machine fitted within the dovetail groove 55 provided on coater blade 27. The front edge of the plate 26 is slightly beveled and the rear edge is provided with the fixture means 56 that attaches to the air cylinder rod arm 57. The air cylinder assembly 58, coupled to an appropriate air source, is of the double acting type and is actuated to move the push plate 26 forward and rearward to apply metered amounts of ink into the gap between the coater blade 27 and surface to be coated.

The FIG. 4 is a cross-sectional view of the applicator of FIG. 3 taken along line A—A. The bottom of the plate 26 is slideably movable on the blade 27 within the groove dovetail 55. The air cylinder movable rod 57 is coupled to the plate 26, and upon actuation, functions to move ink from the inlet tube 32 into the metering gap in the manner described earlier.

It will be noted that while a completely automated type coating applicator is described, the system may be used semi-automatically by manually applying ink to the coater blade 27, e.g., with an eye dropper, and actuating the reciprocating push plate 26 in the manner described herein. Alternatively, a metal block may be affixed to the blade coater and operated in a semi-automated mode to deliver ink to the metering gap to coat the surface.

Other modifications of the above-described invention will become apparent to those skilled in the art and are intended to be incorporated herein.

What is claimed is:

1. A coating apparatus comprising:

a composite blade assembly having a coater blade base, an applicator plate supported on the top surface of said base, means for supplying a coating fluid to the top surface of said base, means for reciprocating said applicator plate forward and backward and means for coordinating the reciprocation of the applicator plate with the supply of coating fluid to the top surface of the coater blade base.

2. Apparatus according to claim 1 wherein coating fluid is supplied by a pump having means for controllably delivering measured quantities of ink to the coater blade surface.

3. Apparatus according to claim 2 wherein said means for controllably delivering measured quantities of ink comprises a metering cam.

4. Apparatus according to claim 3 wherein said metering cam is adjustable for adjusting the volumetric quantity of the ink delivered.

5. Apparatus according to claim 1 wherein said means for reciprocating said applicator plate includes air cylinder means coupled to said applicator plate.

6. Apparatus according to claim 1 wherein said coater blade front edge is beveled to a relief angle from about 65° to 70°.

7. Apparatus according to claim 4 wherein said pump is a peristaltic type pump having a rotary arm and multiple compression rollers.

8. A method for intermittently coating a web with a uniform film of fluid materials comprising the steps of:

a. providing a coating apparatus which includes a composite blade assembly having a coater blade base, an applicator plate supported on the top surface of said base, means for supplying a coating fluid to the top surface of said base, means for reciprocating said applicator blade forward and backward and means for coordinating the reciprocation of the applicator blade with a supply of coating fluid to the top surface of the coater blade base;

b. providing a fluid receptive surface adjacent to said coater blade base;

c. reciprocating the applicator plate in coordination with the supply of coating fluid to the top surface of the coater blade base; and d. causing the fluid on the top surface of the coater blade base to be transported by the reciprocating action of the applicator plate toward the fluid receptive surface whereupon a metered amount of fluid is applied to said receptive surface.

9. The method according to claim 8 further including the step of retracting said applicator plate from its forward position rearward linearly.

10. The method according to claim 9 wherein steps (a) through (d) are repeated.

11. In a photoelectrophoretic imaging apparatus having a substantially transparent injecting electrode adapted to support a liquid imaging suspension, means for dispensing the liquid imaging suspension onto the conductive surface of the injecting electrode and a blocking electrode adapted to contact the imaging suspension on the injecting electrode in an imaging zone, the improvement comprising: a blade coating apparatus including a composite blade assembly having a coater blade base, an applicator plate supported on the top surface of said base, means for supplying a coating fluid to the top surface of said base, means for reciprocating said applicator plate forward and backward and means for coordinating the reciprocation of the applicator plate with the supply of coating fluid to the top surface of the coated blade base.

* * * * *